US012624552B2

(12) United States Patent
Meiswinkel

(10) Patent No.: US 12,624,552 B2
(45) Date of Patent: May 12, 2026

(54) CASING BEAD

(71) Applicant: STOCKTON PRODUCTS, North Las Vegas, NV (US)

(72) Inventor: Kurt Meiswinkel, Hillsborough, CA (US)

(73) Assignee: STOCKTON PRODUCTS, Las Vegas, NV (US)

( * ) Notice: Subject to any disclaimer, the term of this patent is extended or adjusted under 35 U.S.C. 154(b) by 0 days.

(21) Appl. No.: 17/833,055

(22) Filed: Jun. 6, 2022

(65) Prior Publication Data

US 2022/0364369 A1 Nov. 17, 2022

Related U.S. Application Data

(63) Continuation-in-part of application No. 16/016,599, filed on Jun. 23, 2018, now abandoned.

(60) Provisional application No. 62/655,291, filed on Apr. 10, 2018.

(51) Int. Cl.
*E04F 13/06* (2006.01)

(52) U.S. Cl.
CPC ..... *E04F 13/06* (2013.01)

(58) Field of Classification Search
CPC ... E04F 13/06; E04F 2013/065; E04F 13/068; E04F 19/02; E04B 1/765
See application file for complete search history.

(56) References Cited

U.S. PATENT DOCUMENTS 1,097,935 A * 5/1914 Pride ..... E04F 13/06 52/255
1,488,727 A * 4/1924 Alexander ..... E06B 1/58 52/255
1,624,121 A * 4/1927 Thien ..... E04F 13/06 52/255
2,663,390 A 12/1953 Dordel
2,679,156 A 5/1954 McFarland
3,295,268 A * 1/1967 Gaither ..... E04F 13/06 52/255
5,433,051 A * 7/1995 Johansson ..... E04C 5/065 52/367
5,836,122 A 11/1998 Rennich et al.
5,836,135 A * 11/1998 Hagan ..... E04F 19/02 52/836
5,970,671 A 10/1999 Bifano et al.
D459,007 S 6/2002 Campacci
(Continued)

OTHER PUBLICATIONS (https://web.archive.org/web/20161218122626/http://stocktonproducts.com/metal.tpl) , 2016.*

(Continued)

*Primary Examiner* — Brian E Glessner
*Assistant Examiner* — Daniel J Kenny
(74) *Attorney, Agent, or Firm* — Womble Bond Dickinson (US) LLP

(57) ABSTRACT

A casing bead having a J- or J-spur shape comprises, consists essentially of, or consists of an item, e.g., sheet metal, formed in a bent shape. The shape is formed of a first section, followed by a second section, a third section, and a fourth section. Alone, the casing bead's first and fourth sections may have interior uninterrupted facing surfaces, and the second section is substantially perpendicular to the first and fourth sections.

29 Claims, 6 Drawing Sheets

(56) References Cited

U.S. PATENT DOCUMENTS

| | | | | |
|---|---|---|---|---|
| 6,698,144 | B1 * | 3/2004 | Larson | E04F 13/068 52/302.6 |
| 6,729,086 | B2 * | 5/2004 | Razetto | E04F 13/06 52/287.1 |
| 7,546,719 | B1 | 6/2009 | Guevara | |
| 8,869,491 | B2 * | 10/2014 | Little | E04F 13/073 52/745.12 |
| 9,322,208 | B2 * | 4/2016 | Matta | E06B 9/42 |
| D800,345 | S * | 10/2017 | Apanovich | D25/119 |

OTHER PUBLICATIONS

International Search Report and Written Opinion for International Application No. PCT/US2019/026472, mailed Jun. 21, 2019, 12 pages.

* cited by examiner

CASING BEAD

CROSS REFERENCE TO RELATED APPLICATIONS

This application is a continuation-in part of U.S. patent application Ser. No. 16/016,599, entitled "IMPROVED PLATER STOP, DRIP SCREED, PLASTER REVEAL, PLASTER VENT EXPANSION JOINT & CASING BEAD, AND PROCESSES THEREFOR," filed Jun. 23, 2018, by inventor Kurt Meiswinkel, which claims priority to U.S. Provisional Patent Application Ser. No. 62/655,291, entitled "IMPROVED CASING BEAD AND PROCESSES THEREFOR," filed Apr. 10, 2018, by inventor Kurt Meiswinkel, the disclosures of which are incorporated by reference in their entireties.

BACKGROUND OF THE INVENTION

Field of the Invention

The invention relates generally to casing beads and processes for their manufacture and use. In plastering terms, the invention also relates to termination screeds, plaster stops, drip screeds, plaster reveals, plaster vent, expansion joints. and related items with possible relevance in the mechanical, architectural and/or construction arts.

Description of Background Art

In the field of construction, plastering and other finishing procedures contribute to both aesthetics and functionality of surfaces such as walls, soffits, ceilings, and the like. In addition, interfaces such as corners associated with windows, door casings, etc., also demand special attention with respect to plastering and other mudding processes. In such procedures and processes, there are numerous items that may be used to provide measurable functionality. For example, in additional to lath selections, some suppliers/manufacturers offer a broad range of stucco, veneer and plaster accessories including expanded metal corner beads, expansion joints, casing beads and weep screeds.

To illustrate, a #66 short-flange casing bead from Stockton Products may be viewed by a person of ordinary skill in the art as a "state of the art" casing item for the plastering and other architectural finishes industries. Similarly, items such as those shown at https://stocktonproducts.com/metal.tpl (as of the filing date of the present application) represents items with casing-bead-like functionality.

There are numerous of shortcomings associated with prior art casing beads (or trims). For example, proper use of casing technologies requires capable individuals with expertise in general construction, painting, and/or assembly. In turn, labor costs associated with the current state-of-the art casing beads are relatively high for plastering purposes. In addition, casing technologies, when used in high-end finishes, merely provides a final look that may or may not appeal to everyone's aesthetic sense.

Thus, there exist opportunities to provide alternatives and improvements to casing technologies, particularly for high-end construction, commercial and residential practices, that may serve as an economical means for ease of use and for labor and time savings in the art associated with casing beads.

SUMMARY OF THE INVENTION

In a first aspect, the invention provides a casing bead having a J-spur shape comprising, consisting essentially of, or consisting of a sheet formed in a bent shape comprising a first section, a second section, a third section, and a fourth section, wherein the first and fourth sections have interior facing surfaces, and the second section is substantially perpendicular to the first and fourth sections. The third section is typically oriented at less than about 90° relative to the second section.

In another embodiment, the invention provides a process for forming a casing bead as described herein.

In a further embodiment, the invention provides a surface formed using the casing bead as described herein.

The third section may be oriented at about 15° to about 75°, e.g., at about 45° relative to the second section. The first and fourth section sections are substantially parallel to each other. The J shape may include a void and/or substantially identical holes located between and/or spanning across the second and third neighboring sections.

In addition, the invention may include a plurality of holes in the third and/or fourth sections. When a sheet of a desired thickness of, e.g., 10 to 250 mils (mils representing thousandths of inches) is used to form the invention, the sheet may have a thickness sufficient to resist plastic deformation during ordinary use.

Furthermore, a process is provided for forming a casing bead having a J-spur shape consisting essentially of a sheet formed in a bent shape comprising a first section, a second section, a third section, and a fourth section, comprising: (a) cutting out from a flat sheet of, e.g., metal, aluminum, or polyvinyl chloride (PVC), to form a blank of a preform shape; and (b) bending the blank so that the first and fourth sections are formed to have interior facing surfaces and the second section is substantially perpendicular to the first and fourth sections. Typically, step (a) is carried out before step (b).

Further still, the invention provides a casing bead, consisting essentially of: a planar sheet folded or formed in a J-spur shape of a first section, followed by a second section, followed by a third section, and followed by a fourth section. The first and fourth sections have interior facing surfaces. The second section is substantially perpendicular to the first and fourth sections.

In other embodiments, the invention provides for processes for manufacturing and using the casing bead of the invention described herein.

DETAILED DESCRIPTION OF THE INVENTION

Definitions and Overview

Figure 1:
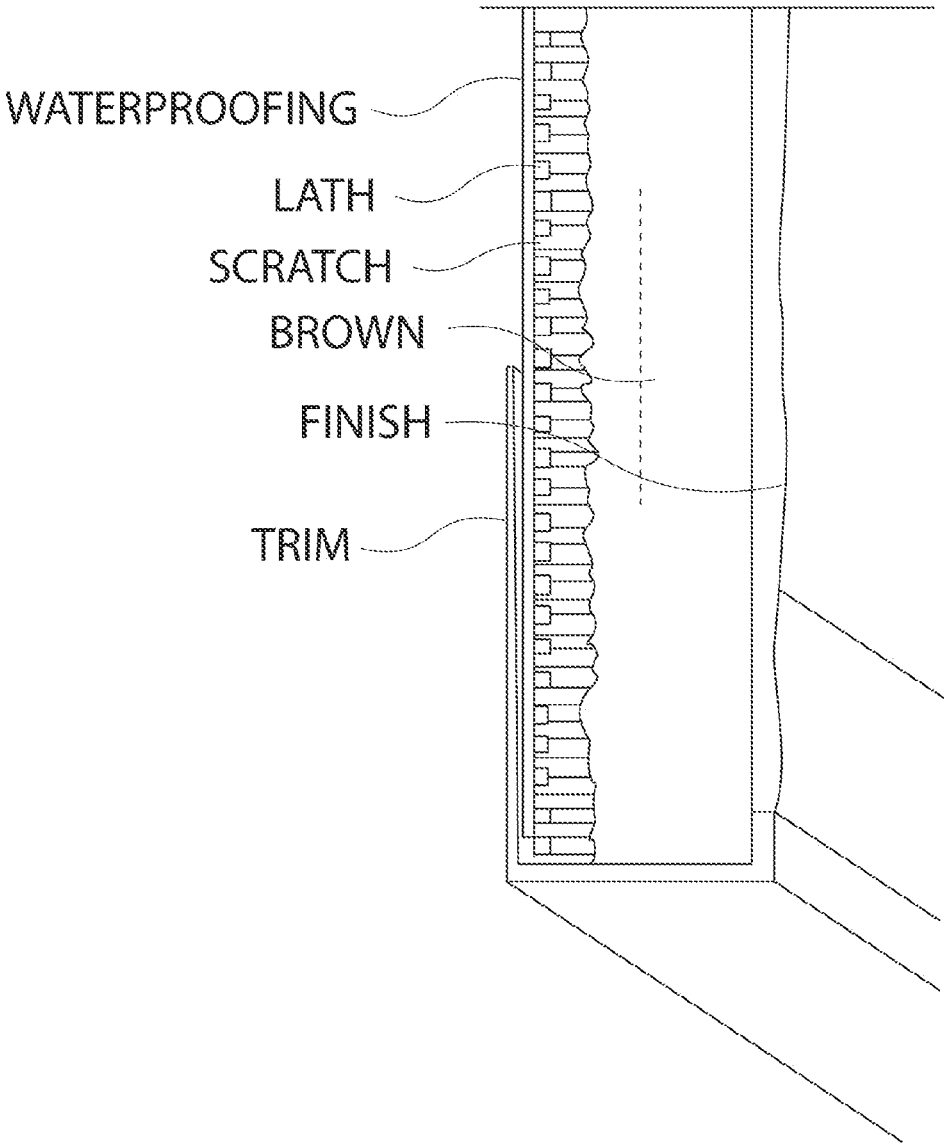
FIG. 1 (PRIOR ART)
FIG. 1 depicts a prior art casing bead in use relative to different coats of mudding associated with the prior art casing.

Before describing the present invention in detail, it is to be understood that the invention is not generally limited to specific geometries and material, as such may vary. It is also to be understood that the terminology used herein are for only describing particular embodiments and are thus generally not intended to be limiting.

In addition, as used in this specification and the appended claims, the singular article forms "a," "an," and "the" include both singular and plural referents unless the context clearly dictates otherwise. Thus, for example, reference to "a casing bead" includes a collection of casing beads as well as a single casing bead, reference to "section" includes a section as well as a plurality of sections, and the like.

Furthermore, terminology indicative or suggestive of a particular spatial relationship between elements of the invention is to be construed in a relative sense rather an absolute sense unless the context of usage clearly dictates to the contrary. For example, the terms "upper" and "lower" as to describe the spatial orientation of an upper section of a casing bead relative to a second section does not necessarily indicate that the first item is located necessarily above the second item. That is, the first item may be located above, at the same level as, or below the second item depending on the casing bead's orientation.

In this specification and in the claims that follow, reference will be made to terms that shall be defined to have the following meanings, unless the context in which they are employed clearly indicates otherwise:

"Casing bead" is used as a term of art and refers, e.g., to a bead or a unitary assembly of members that is typically used in conjunction with plastering, stucco, and like casing practices for high-end construction purposes. "Casing bead" is intended to encompass "screeds," "casings," "weeps," "channel reveals," "grounds," "expansion joints" built in aluminum, PVC or steel window frames" and the like. For further information, see http://fryreglet.com/downloads_shapefinder/channelscreedcontroljoint.pdf; https://www.cemcosteel.com/metal-lath/metal-lath-accessories/screeds-casings-weeps; http://www.vinylcorp.com/products/stucco-plaster/casing-beads http://www.vinylcorp.com/products/stucco-plaster/channel-reveals; http://www.amico-lath.com/lath/casing_bead.htm; http://www.phillipsmfg.com/stucco-and-plaster-casing-beads/; http://sweets.construction.com/swts_content_files/1097/537754.pdf; and https://stocktonproducts.com/metal.tpl.

The term "consisting essentially of" and the like are used in their legal sense as transitional phrases. They are to be interpreted as semi-open manner, i.e., between open transitional phrases "comprising" or "comprised of" and the closed transitional phrase "consists of." Thus, "consists essentially of" should not be interpreted synonymously as "comprising" or "comprised of." Similarly, "consisting essentially of" should not be interpreted synonymously as "consisting of" Additional resources pertaining to the proper interpretation of "consisting essentially of" and the like can be found, e.g., in the most recent edition of the Manual of Patent Examining Procedures 2111.03, as of the filing date of this patent application.

The term "high-end" (or "high end") is used in its ordinary sense and refers to denoting the most expensive of a range of products in the context of the present invention. The term also implies high value. Synonyms of "high end" include, for example, superior, premier, top-end, exclusive, elite, top, select, choice, deluxe, luxurious, classy, prime, first-rate, high-quality, top-quality, high-grade, five-star, fine, etc. Optimally, "high-end" may be used to refer to a high value-to-cost ratio as construed in a general technological, economic and legal sense.

Examples of high-end construction projects include those performed on behalf of high net-worth individuals, e.g., billionaires and other titans of technological industry. Thus, the term "high-end" as used herein relates to finishes that exudes luxury, without necessarily the relatively high prices that is sometimes associated with luxury. Thus, for example, high end plaster finishes typically exhibit a generally smooth surface without obvious deformities such as bumpiness that may characterize low-end or shoddy workmanship.

The term "economical" is used herein in its ordinary sense and is used to refer to providing a good or excellent value or service in relation to the amount of money, time, or effort spent.

The terms "property" and "properties" are used in their ordinary sense and refer to an attribute, quality, or characteristic of something, e.g., the invention or a component thereof.

The term "substantially identical" as used to describe a plurality of items is used to indicate that the items are identical to a considerable degree, but that absolute identicalness is not required. For example, when perforations are described herein as of a "substantially identical size," the perforations' size may be identical or sufficiently near identical such that any differences in their size are trivial in nature and do not adversely affect the performance of the perforations' function. The terms "substantial" and "substantially" are used analogously in other contexts involve an analogous definition.

Casing Beads

In general, the invention relates casing beads, e.g., a molding or strip that acts as a stop, an edge, or a separation typically between different materials, typically used in the construction industries. Rough best mode but enabling information pertaining to the invention can be found in U.S. Ser. No. 62/655,291.

FIG. 1 provides a visual representation of an embodiment of the invention claimed (new technology), relative to prior art (old) technology.

Figure 2:
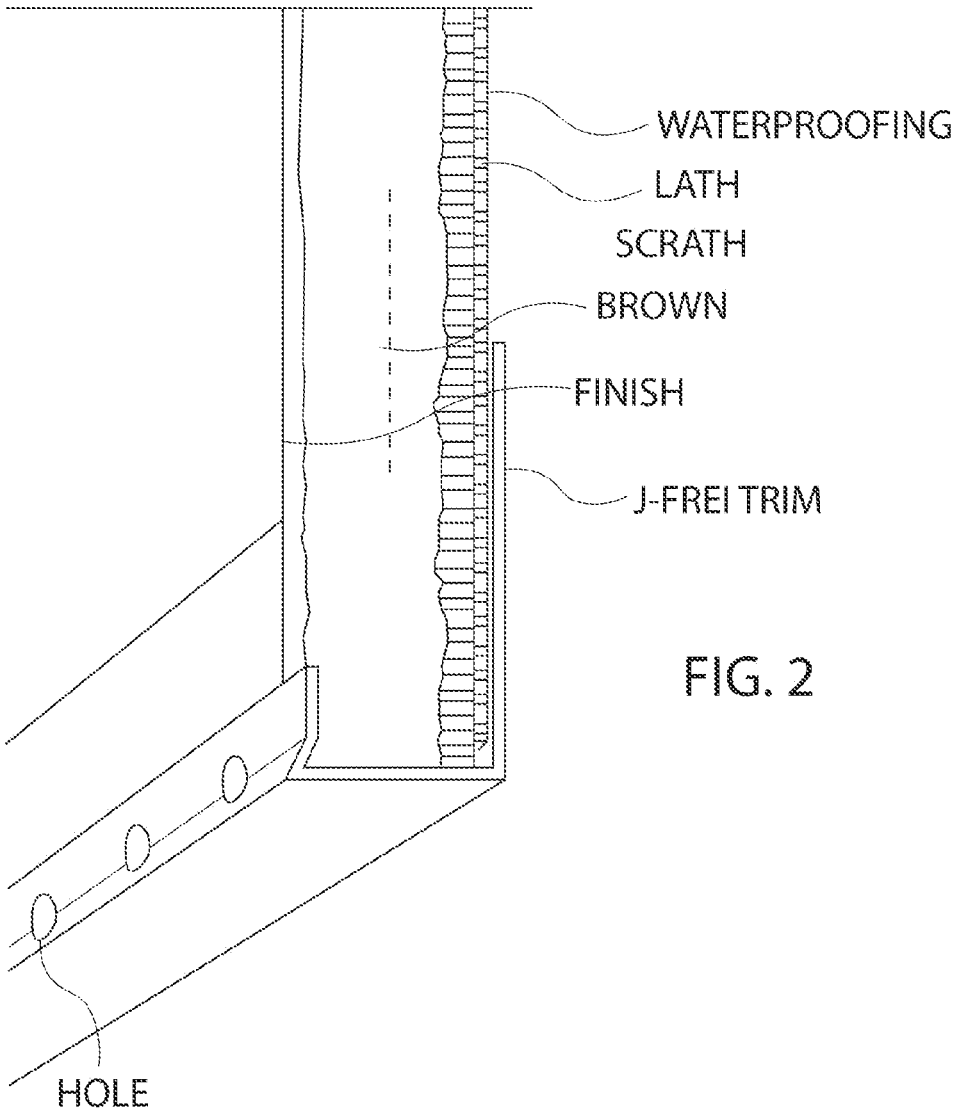
FIG. 2 is line drawing depicting an embodiment of the inventive casing bead, which is labeled as a J-Frei trim, in context with proper mudding layers and other construction aspects of the invention associated the inventive embodiment.

FIG. 2 is a schematic of an exemplary embodiment of the invention. This embodiment may or may not represent a best mode of the invention.

Figure 3:
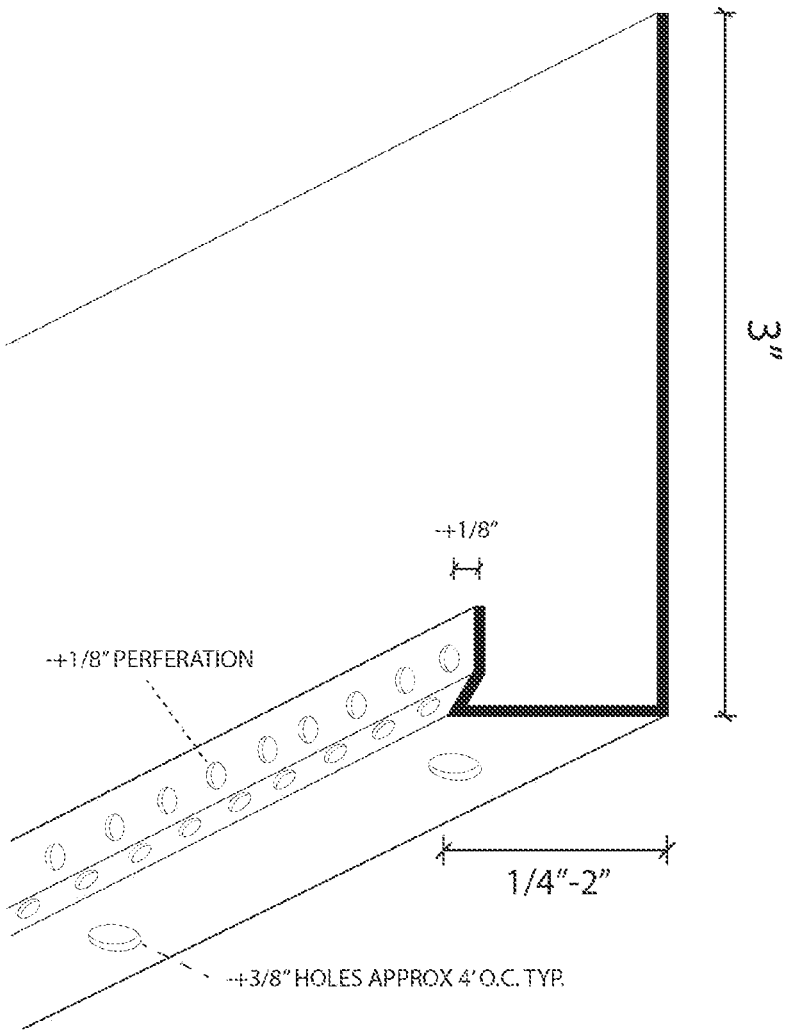
FIG. 3 is a hand drawing depicted another embodiment of the inventive casing bead, with exemplary dimensions.

FIG. 3 provides details regarding a technological baseline from which the invention improves.

Figure 4:
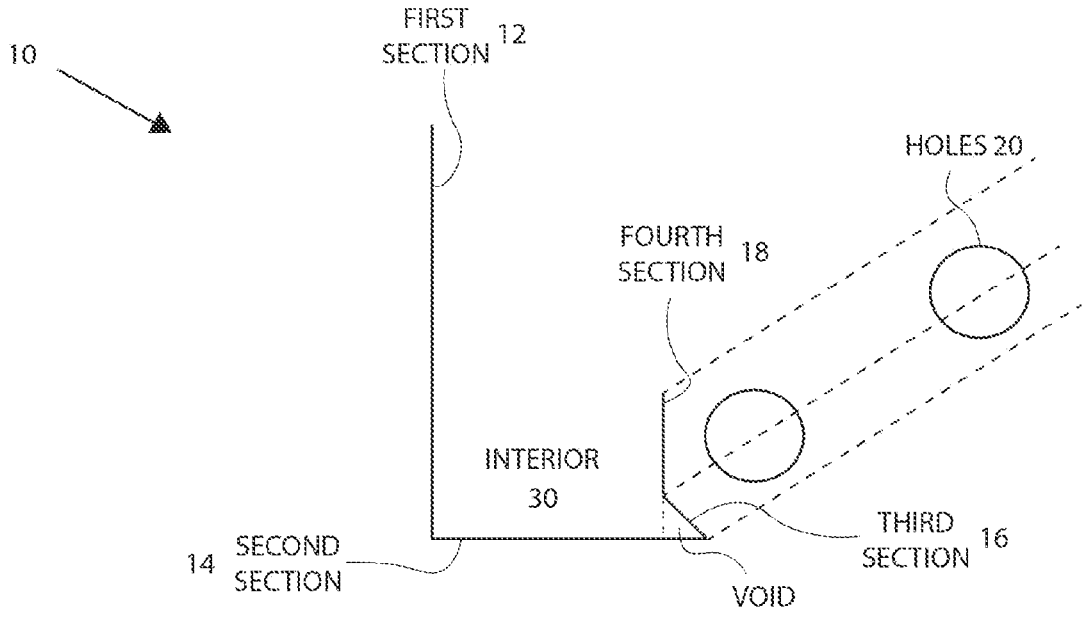
FIG. 4 is a modified line drawing of FIG. 2, with added identification of first, second, third, and fourth sections of the inventive form, as well as with added identification of a void defined at least in part by the second and the third sections.

FIG. 4 depicts selected elements of the invention that support a finding of utility, novelty, and nonobviousness.

Figure 5:
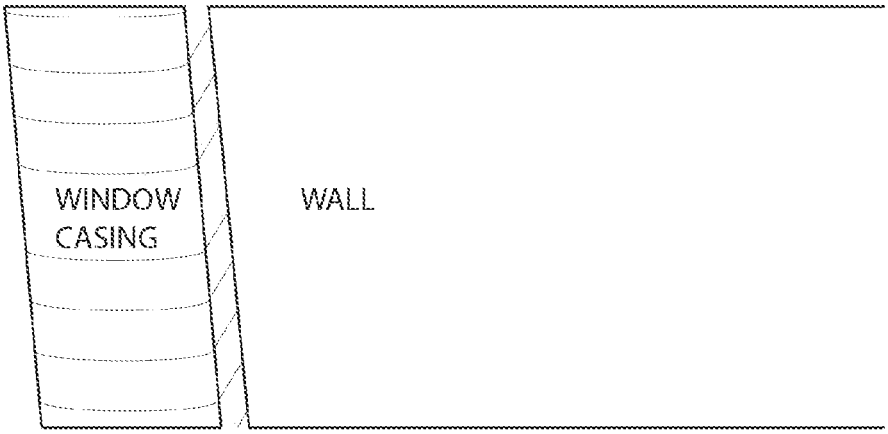
FIG. 5 is a drawing depiction of a photograph of the interface between a plaster wall and a window casing having a gap therebetween, the interface/gap established using the inventive casing bead, thereby illustrating an example of a high-end finish that is achieved through economical means, the economical means effective to save on labor costs for, e.g., painting the plaster wall and the window casing using different paints without need for painter's tape.

FIG. 5 provides an illustration of how the invention may be used to further distinguish the claimed technology from the prior art in terms of aesthetic utility, novelty, and nonobviousness. As shown, FIG. 5 illustrates that a gap may be provided between a window casing and a wall, using an embodiment of the invention. Such a gap represents a labor-saving means because painters tape may not be needed when the surface of the window casing is to be painted a different color (or with a different paint) relative to the surface of the wall. In turn, this photograph demonstrates another novel and nonobvious aspect of the invention in terms of the economical nature of the invention as well as the high-end aspect of the invention.

For example, the window casing may be painted a color different from the wall and vice versa. Similarly, different finishes, e.g., natural, flat, satin, semigloss, or glossy, may be provided on the window casing and the wall. Painting labor costs may be saved while the invention provides a means for economically providing a high-end finish.

Figure 6:
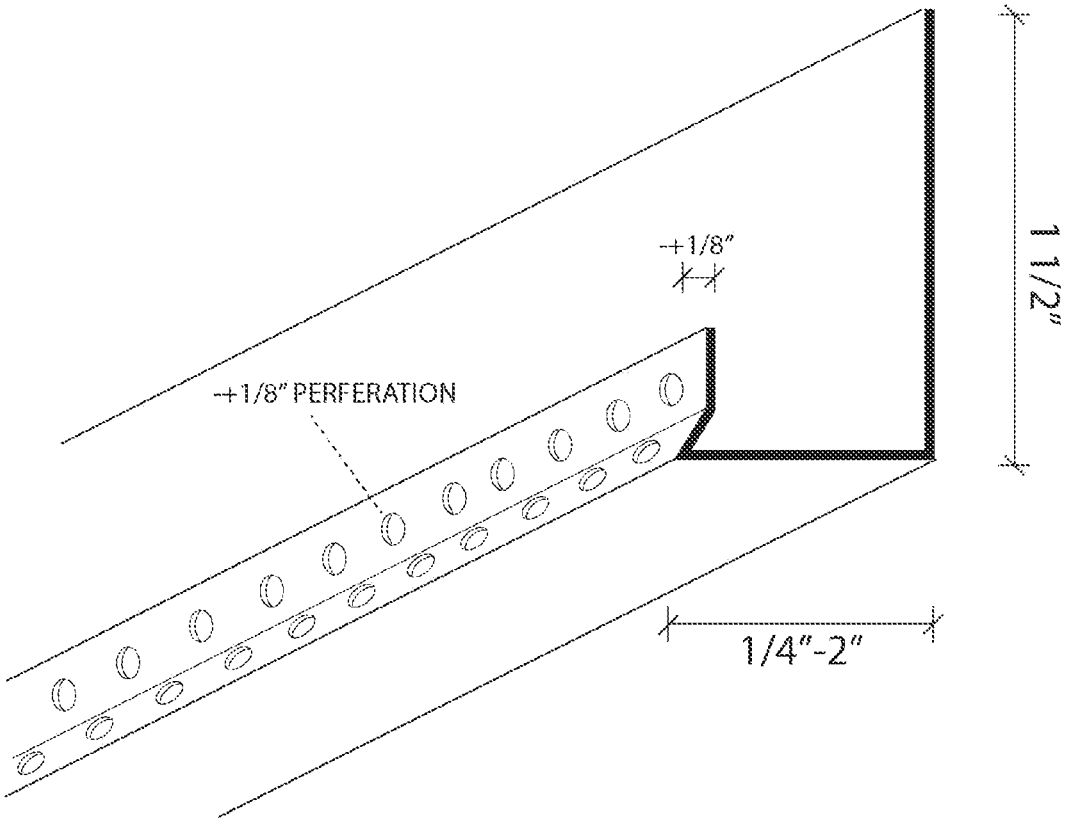
FIG. 6 is another hand drawing that depicts another embodiment of the invention that is similar, but different, from that depicted in FIG. 3.

The hand drawn sketch in FIG. 6 depicts various aspects of the invention. FIG. 6 may be used to communicate to an ordinary artisan as how the inventive bead may be constructed by a manufacturer, e.g., by punching a folding sheet metal.

An exemplary prototype is now discussed. The prototype has a generally and J- or J-spur shape and is made from about twenty-six, e.g., about 20 to 30, gauge shim stock. The prototype 10 includes a first section 12, a second section 14, a third section 16, and a fourth section 18. Section 12 is about 1.5 inches in length and is the longest section. Section 14 is about ⅞ inch in length and is the second longest section, Sections 16 and 18 are each both shorter than section 14 and are about ½ inch in length. Section 12 faces each of sections 16 and 18 without any intervening section therebetween.

An angle between sections 12 and 14 is designated as A. An angle between sections 14 and 16 is designated as B. An angle between sections 18 and are photographs of a prototype of an embodiment of the invention. Angle A includes is approximately 90°. Angle B is less than 90°. Angle C is greater than 90° but less than 180°. The radius of curvature for angles A, B, and C is quite small (less than about 10%, 5% or 1%) relative to the length of sections 12, 14, 16, and 18.

Circular holes 20 are punched through sections 16 and 18 at the corner defined angle C. However, hole, circular or noncircular can be located at other locations as well, e.g., through sections 12, 14, 16, and/or 15. Such holes help plaster finish to adhere to a brown coat, plasterboard or sheetrock placed in the interior region 30 of the prototype 10. However, any holes of any shape may be used to help plaster finish to adhere to a brown coat, as long as such holes do not interfere with any other step associated with the formation of a high-end finish and that such holes do not add more labor and/or material costs to construction projects.

In general, the invention helps construction workers save time and effort in providing a medium- to high-end finish in matters such as drywall, plastering, sill work, and the like. For example, the invention allows workers to avoid having to tape and de-tape when engaged in trim paint work. In addition, the invention provides a way to enhance mechanical properties and behavior of finishes. For example, Applicant has found that the invention unexpectedly reduces instances of cracking in plastering efforts. That is, the invention helps to eliminate the need to re-mud over cracks formed by inexperienced use of prior art casing beads. In sum, the invention allows inexperienced workers to work better and experienced workers save time.

Thus, in one embodiment, the invention provides a perfect ¾" ground for the cement brown coat to prepare for finishes.

The invention also may provide improved slightly thermal insulation properties at interfaces, e.g., between a window casing and walls due to the presence of the void formed between the second section and the third section. When unfilled, the void is expected to be contain effectively immobilized air, and air is a well-known thermal insulator rather than a temperature conductor.

Thus, the invention provides a number of novel and nonobvious aspects over prior art technologies. In addition to the novel and nonobvious aspects of the invention generally identified herein, the invention provides as a whole, a geometry not known or suggested in the art. Combinations of straight edges and holes, unexpectedly, allows construction worker to use a protruding straight edge guide for neatly applying a drywall compound using a trowel without having holes of the invention interfering with the drywall compound application. In fact, the holes of the invention work synergistically to provide a high-end and economical finish in the areas of construction such as plaster finishes and painting. In other words, the holes and edges of the invention work in concert, rather than in opposition, relative to each other.

VARIATIONS ON THE INVENTION

Variations of the present invention will be apparent to those of ordinary skill in the art in view of the disclosure contained herein. For example, when the invention is made from sheet metal, a punch or some other cutter may first preform the sheet and then bent the sheet in to the desired shape. Alternatively, a sheet may be formed in to a desired shape before holes or perforations are introduced. Holes may be introduced to facilitate plaster adherence, e.g., to sheet rock, plasterboard, and/or the inventive bead casing itself.

In addition, more than one sheet may be joined to form the inventive item. For example, a hole-containing sheet may be welded or otherwise permanently joined to a non-holed sheet to form the inventive item.

Suitable materials for forming the casing bead of the invention include, e.g., metals such as steel, galvanized steel, copper, zinc, aluminum, stainless steel, as well as polymers such as polyvinyl chloride and other known industrial plastics. Care must be taken in materials selection because the invention is particularly sensitive to temperature and mechanical properties associated therewith respect to plaster cracking and workman handling issues.

Is should also be noted that both the leg and the return dimensions can vary to any length but the overall design/special shape of the trim (casing bead) will typically remain the same, e.g., as depicted and/or claimed. The number of plaster or other coats to be used with respect to the invention may be 1, 2, 3, 4, 5, 6 or more depending on the intended and effected final result.

It should also be noted that the invention may exhibit handedness. In general, the dominant handedness of the invention is deemed to be right-handed, but the invention may involve left-handed embodiments as well. Such handed embodiments may exhibit mirror symmetry when viewed together, or mirror or other types of symmetry may be absent. In extreme cases, the invention may involve a geometry that is more similar to a generalized U-shape than a J-shape. In such a case, the U-shape may be encompassed by the J-shape or the J-spur shape unless the context of actual usage in construction clearly indicates to the contrary.

The invention is typically compatible with existing bead technology. For example, the invention may involve the use of the invention as, or in combination with expansion joints, vent screeds, reveal screed, foundation screeds, drip screeds, as well. The invention may also exhibit versatility with respect to angled screeds and other construction details. As a result, the invention provides a new and improved overall plaster termination screed.

The invention may be carried out such that the shape formed as has an interior region of a thickness dimension appropriate to local measurement standards. For example, when local dimensional measurement standards are in inches, the thickness dimension may be 1 in, ⅝ in, 0.5 in, 0.25 in or any other convenient dimension appropriate to the needs of the construction project at hand. Similarly, when local dimensional measurement standards are metric in nature, the thickness dimension may be 1 cm, 2 cm. etc. Care must be taken to ensure that the invention comports with local construction/building codes and standards.

Additional variations of the invention may be discovered without departing from the spirit of the present invention. For example, the invention may be adapted to exhibit any of numerous of finishes, e.g., shiny, matte, embossed, etc., to achieve a high-end result. In addition, the invention may be adapted to exhibit any of numerous surface colors, so as to save labor cost on painting efforts.

It is to be understood that, while the invention has been described in conjunction with the preferred specific embodiments thereof, the foregoing description merely illustrates and does not limit the scope of the invention. For example, while the foregoing description focuses on square corners and flat sheets, the invention may also be of use in appropriate curved surface environments as well.

In any case, numerous alternatives and equivalents exist which do not depart from the invention set forth above. For example, the inventive apparatus may be constructed to contain or exclude specific features and components according to the intended use of the apparatus, and any particular embodiment of the invention, e.g., those depicted in any drawing herein, may be modified to include or exclude element of other embodiments. Alternatively, stated, different features of the invention described above may be combined in different ways. Other aspects, advantages, and modifications within the scope of the invention will be apparent to those skilled in the art to which the invention pertains.

All patent applications, and publications mentioned herein are incorporated by reference to an extent not inconsistent with the above disclosure.

What is claimed is:

1. A casing bead, comprising:

a bent sheet having a first section, a second section extending perpendicularly relative to the first section, a third section extending at an angle that is less than 90° relative to the second section, and a fourth section extending at an angle greater than 90° relative to the third section, the fourth section being shorter than the first section, wherein the first and fourth sections have interior-facing, substantially parallel surfaces, the second section is substantially perpendicular to the first and fourth sections, the third section is for supporting an end of a finish material above it, a spur is defined by the second and third sections, wherein the first, second, third, and fourth sections define a space for receiving a first material, and at least one opening is formed through the third section for receiving said first material from said space, wherein the third and fourth sections have an outer surface facing away from the first section for receiving a finish material for contacting said first material received in said at least one opening, and wherein when received in said at least one opening, the first material is a wet cementitious material.

2. The casing bead of claim 1, wherein the third section is oriented at about 15° to about 75° relative to the second section.

3. The casing bead of claim 1, wherein the third section is oriented at about 45° relative to the second section.

4. The casing bead of claim 1, wherein the first and fourth sections are substantially parallel to each other.

5. The casing bead of claim 1, wherein the sheet is metallic or polymeric.

6. The casing bead of claim 1, wherein said at least one opening comprises a plurality of first openings formed through the third section and a plurality of second openings are formed through the fourth section.

7. The casing bead of claim 1, wherein the first material is a brown coat and the finish material is plaster.

8. The casing bead of claim 1, the first wherein said at least one opening is a single opening penetrating said third and fourth sections.

9. A casing bead comprising:

a sheet having a first section, followed by a second section extending generally perpendicularly relative to the first section, followed by a third section extending at an angle that is less than 90° relative to the second section, and followed by a fourth section extending at an angle greater than 90° relative to the third section, the fourth section being shorter than the first section, wherein, the first and fourth sections have interior facing surfaces, the second section is generally perpendicular to the first and fourth sections, wherein the first, second, third, and fourth sections define a space for receiving a first material, a spur is defined by the second and third sections, the third section is for supporting an end of a finish material above it, and at least one opening is formed through the third section for receiving said first material from said space, wherein when received in said at least one opening, the first material is a wet cementitious material.

10. The casing bead of claim 9, wherein the sheet has a thickness sufficient to resist deformation.

11. The casing bead of claim 10, wherein the sheet thickness is 10 to 250 mils.

12. The casing bead of claim 9, wherein the sheet is metallic or polymeric.

13. The casing bead of claim 9, wherein said at least one opening comprises a plurality of first openings formed through the third section and a plurality of second openings formed through the fourth section.

14. The casing bead of claim 9, wherein the third and fourth sections have an outer surface opposite the first section for receiving a finish material for contacting said first material received in said first and second openings.

15. The casing bead of claim 14, wherein the first material is a brown coat and the finish material is plaster.

16. The casing bead of claim 9, wherein said at least one opening is a single opening penetrating said third and fourth sections.

17. An exterior wall comprising:

a casing bead comprising, a first section, a second section extending perpendicularly from to the first section, a third section having a first opening formed therethrough and extending at an angle that is less than 90° from to the second section, and a fourth section having a second opening formed therethrough and extending at an angle greater than 90° relative to the third section, wherein the first, second, third and fourth sections define a general J shape;

a first material received within the casing bead J-shape and being received in the first and second openings; and a finish material extending over an outer surface of the fourth section and having an end over an outer surface of the third section, said finish material contacting the first material received through said first and second openings.

18. The exterior wall of claim 17, wherein the first material is brown coat.

19. The exterior wall of claim 17, wherein the finish material is plaster.

20. The exterior wall of claim 17, wherein the first and second openings intersect each other.

21. The exterior wall of claim 17, wherein a plurality of first openings are formed through the third section and a plurality of second openings are formed through the fourth section.

22. A casing bead, comprising:

a bent sheet having a first section, a second section extending perpendicularly relative to the first section, a third section extending at an angle that is less than 90° relative to the second section, and a fourth section extending at an angle greater than 90° relative to the third section, the fourth section being shorter than the first section, wherein the first and fourth sections have interior-facing, substantially parallel surfaces, the second section is substantially perpendicular to the first and fourth sections, a spur is defined by the second and third sections, wherein the first, second, third, and fourth sections define a space for receiving a first material, and at least one opening is formed through the third and fourth sections for receiving said first material from said space, wherein the third and fourth sections have an outer surface facing away from the first section for receiving a finish material for contacting said first material received in said at least one opening, and wherein the third section is for receiving an end of said finish material.

23. A casing bead comprising:

a sheet having a first section, followed by a second section extending transversely relative to the first section, followed by a third section extending at an angle that is less than 90° relative to the second section, and followed by a fourth section extending at an angle greater than 90° relative to the third section, the fourth section being shorter than the first section, wherein the first and fourth sections have interior facing surfaces, the second section is transverse to the first and fourth sections, wherein the first, second, third, and fourth sections define a space for receiving a first material, a spur is defined by the second and third sections, and an opening is formed through the third section for receiving said first material from said space.

24. A casing bead, comprising:

a bent sheet having a first section, a second section extending transversely relative to the first section, a third section extending at an angle that is less than 90° relative to the second section, and a fourth section extending at an angle greater than 90° relative to the third section, the fourth section being shorter than the first section, wherein the first and fourth sections have interior-facing, substantially parallel surfaces, the second section is substantially perpendicular to the first and fourth sections, a spur is defined by the second and third sections, wherein the first, second, third, and fourth sections define a space for receiving a first material, and an opening is formed through the third section for receiving said first material from said space, wherein the third and fourth sections have an outer surface opposite the first section for receiving a finish material for contacting said first material received in said opening, wherein when received in the opening, the first material is a wet cementitious material.

25. The casing bead of claim 24, wherein a plurality of first openings are formed through the third section.

26. The casing bead of claim 24, wherein the second section extends perpendicularly relative to the first section.

27. The casing bead of claim 24, wherein another opening is formed through the fourth section.

28. The casing bead of claim 24, wherein said opening is also formed through the fourth section.

29. The casing bead of claim 23, wherein the second section extends generally perpendicular to the first section.

* * * * *